United States Patent [19]

Jenkel et al.

[11] 4,206,725

[45] Jun. 10, 1980

[54] INJECTION NOZZLE CLAMP

[75] Inventors: Howard D. Jenkel, Washington; Victor L. Sheldon, Jr., Chillicothe, both of Ill.

[73] Assignee: Caterpillar Tractor Co., Peoria, Ill.

[21] Appl. No.: 973,041

[22] Filed: Nov. 29, 1978

[51] Int. Cl.[2] ..... F02M 39/00

[52] U.S. Cl. ..... 123/32 R; 123/139 AW; 123/32 JV

[58] Field of Search ..... 123/32 JT, 32 R, 32 JV, 123/32 H, 198 A, 139 AW; 239/533.1–533.15, 584

[56] References Cited

U.S. PATENT DOCUMENTS

| | | | |
|---|---|---|---|
| 2,144,861 | 1/1939 | Truxell, Jr. | 123/32 R |
| 3,038,456 | 6/1962 | Dreisin | 123/32 |
| 3,695,235 | 10/1972 | Anderson | 123/32 R |
| 4,133,321 | 1/1979 | Hofmann et al. | 123/32 R |

FOREIGN PATENT DOCUMENTS

| | | | |
|---|---|---|---|
| 2649357 | 3/1978 | Fed. Rep. of Germany . | |
| 1089892 | 3/1955 | France | 123/32 JT |

*Primary Examiner*—P. S. Lall

*Attorney, Agent, or Firm*—Wegner, Stellman, McCord, Wiles & Wood

[57] ABSTRACT

An engine structure (12) wherein a fuel injector nozzle (11) is retained in accurate preselected association with the cylinder head (16) by an improved clamp (20). The clamp is associated with a force-applying device (24) and the nozzle head (13) so as to provide an accurate transfer of force from the force-applying device (24) to the nozzle parallel to the longitudinal axis (20) of the nozzle and in a manner accurately positioning the nozzle about its longitudinal axis. The clamp is associated with the force-applying device and the nozzle head so as to have non-surface engagement between the force transfer portions (21,28, 31,19, and 34,35) and in the illustrated form, utilizes line contact force transfers therebetween. The line contacts are preselected so as to be parallel to each other in providing the desirable accurate force transfer.

16 Claims, 5 Drawing Figures

INJECTION NOZZLE CLAMP

TECHNICAL FIELD

This invention relates to fuel injection systems and in particular to a clamp for retaining the fuel injecting nozzle in position on a cylinder head.

BACKGROUND ART

As shown in German Pat. No. 26 49 357 of Hans List, it is known to secure the fuel injection nozzle of an internal combustion engine to a cylinder head so as to extend through a bore in the cylinder head to the piston cylinder. The nozzle includes an outer body portion which is engaged by a suitable clamp to retain the nozzle in the desired installed disposition.

More specifically in the German patent, the means for retaining the nozzle in such disposition comprises a forked pressure piece engaging complementary pressure surfaces milled into the injector body.

The forked pressure piece is retained in pressure-applying disposition by a bolt which extends through a portion of the pressure piece so as to be threaded into the cylinder adjacent the injector nozzle bore.

In certain installations, the injector nozzle may extend at an angle to the outer surface of the cylinder and problems have arisen in applying the retaining force from the clamp to the nozzle so as to positively retain the nozzle against loosening and withdrawal from the cylinder head. In the German patent structure, the clamp defines a force-applying surface having surface engagement with the pressure surfaces of the nozzle and planar surfaces associated with the bolt means for transferring the retaining force from the bolt means to the pressure piece.

The arrangement of the German patent is undesirable in that accurate orientation of the retaining force applied from the pressure piece to the nozzle requires high accuracy in the parallel disposition of the different surfaces through which the clamping force is transferred. Thus, in the structures of the prior art such as that disclosed in the above discussed German patent, problems have arisen in maintaining the nozzle positively and accurately mounted to the cylinder head.

DISCLOSURE OF INVENTION

The present invention comprehends an improved engine structure wherein an improved clamping arrangement is provided assuring accurate alignment of the force transferred from the clamp to the fuel injector nozzle so as to avoid the problems of the prior art in a novel and simple manner.

More specifically, the invention comprehends the provision of such clamping means secured to the cylinder head and forcibly engaging the nozzle body for concurrently positioning the nozzle in a preselected disposition about its longitudinal extent and applying a force to the nozzle urging the nozzle inwardly accurately to the direction of longitudinal extent thereof.

More specifically, the invention comprehends the provision of such an engine structure wherein the clamp is provided with a fulcrum portion, a force-receiving portion, and a force-applying portion. These clamp portions are arranged so that a clamping force applied to the force-receiving portion tends to urge the force-applying portion about the fulcrum portion engaging the outer surface of the cylinder head whereby the nozzle is urged inwardly accurately in the direction of longitudinal extent of the nozzle. In the illustrated embodiment of the invention, the retaining means is shown for use with an engine structure having a head defining a piston cylinder, an outer surface portion, a bore extending through the outer surface portion and opening into the cylinder, and a fuel injector nozzle having an outer body portion disposed outwardly of the head outer surface portion and an elongated lower end portion extending longitudinally inwardly through the nozzle opening to the cylinder. The retaining means more specifically includes a clamp having a fulcrum engaging the head outer surface portion, a force-applying portion, and a force-receiving portion disposed intermediate the fulcrum and force-applying portions to define therewith a third class lever whereby a clamping force applied to the force-receiving portion urges the force-applying portion about the fulcrum portion, and means for applying a clamping force to the clamp force-receiving portion, the nozzle body portion defining a holding surface in line contact with the clamp force-applying portion for urging the nozzle inwardly accurately in the direction of longitudinal extent of the nozzle and into sealed association with the head as a result of the application of the clamping force to the force-receiving portion.

In the illustrated embodiment, the contacts between the different force transfer surfaces are preferably line contacts so as to permit self-adjustment of the direction of the transmitted forces so as to assure that the clamping force is directed accurately parallel to the longitudinal extent of the nozzle as discussed above.

More specifically in the illustrated embodiment, the force-receiving surface, the force-applying surface, and the fulcrum of the clamp are segmentally cylindrical so as to provide a line contact force transfer between the associated elements of the structure.

Further in the illustrated embodiment, the nozzle body is provided with a pair of recesses each defining a holding surface, the clamp comprising a bifurcated clamp having leg portions defining a pair of force-applying surfaces engaging the holding surfaces of the nozzle so as to effect a plurality of retaining forces acting accurately parallel to the longitudinal extent of the nozzle. Additional surfaces of the recesses may cooperate with additional surfaces of the clamp legs so as to provide the desirable accurate positioning of the nozzle about the longitudinal extent thereof.

In the illustrated embodiment, the clamp is arranged to define a third class lever wherein the force-receiving portion of the clamp is disposed intermediate the fulcrum and the force-applying portion engaging the nozzle.

Thus, the nozzle retaining means of the present invention is extremely simple and economical of construction while yet providing the highly desirable accurate positioning and retention of the fuel injector nozzle in the engine structure as discussed above.

BEST MODE FOR CARRYING OUT THE INVENTION

Figure 1:
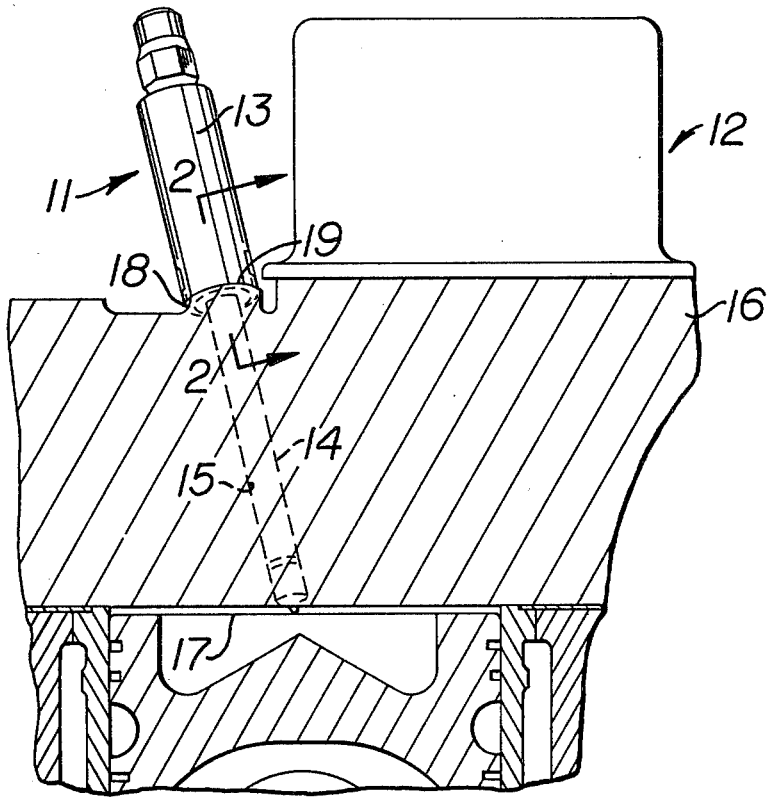
FIG. 1 is a fragmentary section illustrating the disposition of a fuel injector nozzle in association with an internal combustion engine structure adapted to be retained by a retaining means embodying the invention.

In the illustrative embodiment of the invention as disclosed in the drawing, an improved clamping structure generally designated 10 is provided for use in retaining a fuel injector nozzle generally designated 11 in installed association with an engine generally designated 12. As shown in FIG. 1, the nozzle 11 includes an outer body portion 13 and an inner end portion generally designated 14 extending through a bore 15 in the cylinder head 16 of engine 12 for injecting fuel into a piston cylinder 17 of the engine 12. The cylinder head may be provided with a boss 18 having an outer canted surface 19 against which the body 13 of nozzle 11 is urged in the installed arrangement, as seen in FIG. 1.

As indicated above, the present invention is concerned with an improved clamping structure 10 providing an improved accurate retention of the nozzle 11 in association with the cylinder head 16. More specifically, the invention comprehends providing such a clamping structure which accurately directs the retaining force axially, or in the direction of longitudinal extent, of the nozzle 11 and which further accurately positions the nozzle about its longitudinal axis 20' for improved delivery of the injected fuel into the cylinder 17.

Figure 2:
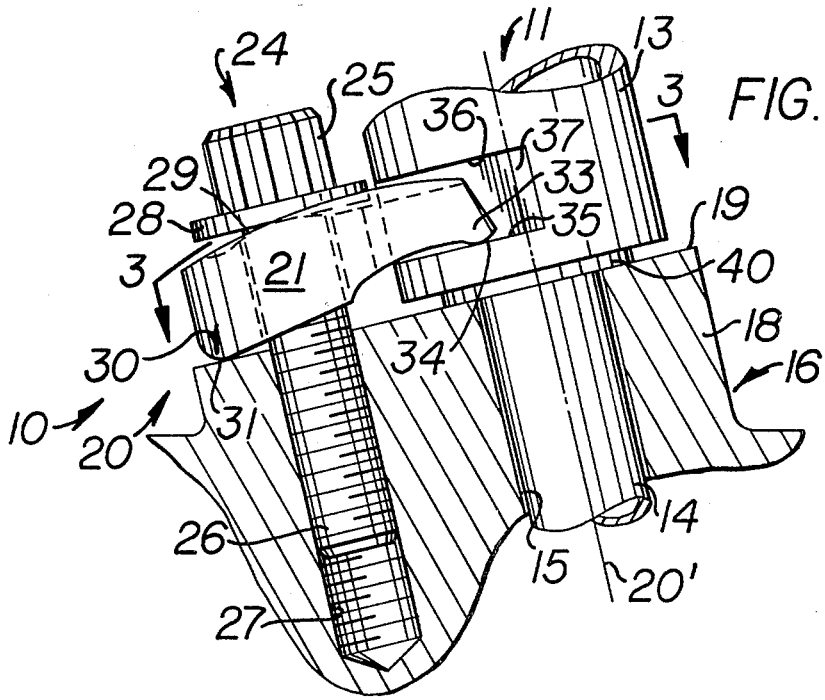
FIG. 2 is a transverse section taken substantially along the line 2—2 of FIG. 1.

Referring now more specifically to FIGS. 2–5, the clamping structure 10 includes a bifurcated clamp 20 having a securing portion 21 and a pair of outwardly projecting legs 22 and 23. The securing portion 21 cooperates with a force-applying means 24 illustratively comprising a bolt having a head 25 and a threaded shank 26. Shank 26 is threaded into a complementary threaded bore 27 in the cylinder head extending parallel to the axis of bore 15, as seen in FIG. 2.

A collar 28 on the bolt shank engages the securing portion 21 of the clamp which is provided with a rounded, segmentally cylindrical force-receiving surface 29 so as to have line contact therebetween.

Figure 3:
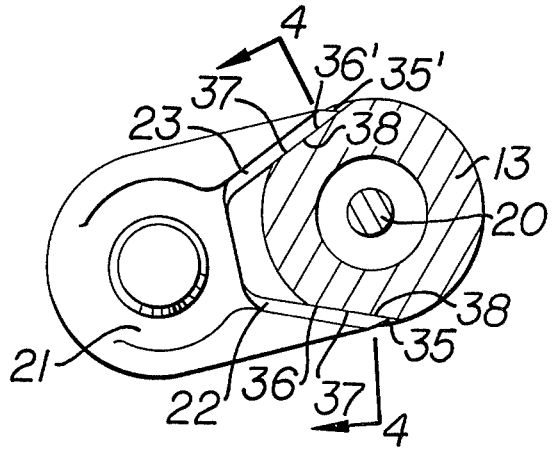
FIG. 3 is a transverse section taken substantially along the line 3—3 of FIG. 2.
Figure 4:
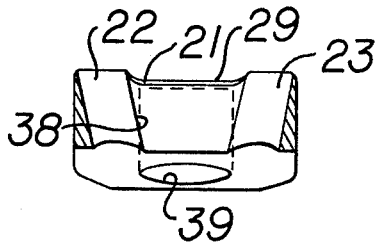
FIG. 4 is a transverse section taken substantially along the line 4—4 of FIG. 3.

As further best seen in FIG. 2, the clamp 20 further includes a fulcrum portion 30 defined by a segmentally cylindrical surface 31 having line contact with the boss surface 19 of the cylinder head. Clamp 20 further includes a force-applying portion 33 defined by a segmentally cylindrical surface 34 engaging a holding surface 35 defining the inner transverse surface of a slot recess 36 provided in the nozzle body 13, as shown in FIG. 2. As best seen in FIG. 3, the nozzle body 13 is provided with a second such recess 36' defining a second such holding surface 35' at the opposite side of the body, the recesses converging toward the body securing portion 21 and being complementary to the legs 22 and 23 of the clamp. Each of the recesses define a longitudinally extending side surface 37 facially engaged by the complementary planar side surfaces 38 defining the inner confronting surfaces of legs 22 and 23. Thus, as seen in FIG. 3, engagement of the legs 22 and 23 with the nozzle body in recesses 36 and 36' provides an accurate positioning of the nozzle body 13 about the longitudinal axis 20' thereof.

Figure 5:
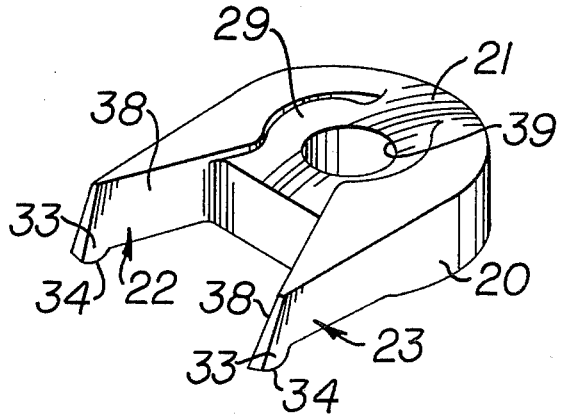
FIG. 5 is a perspective view of the clamp.

As further best seen in FIG. 5, the securing portion 21 of clamp 20 is provided with a through bore 39 through which extends the shank 26 of bolt 24 so as to permit threaded adjustment of the bolt to force the collar 28 against the segmentally cylindrical force-receiving surface 29 of the clamp securing portion and thereby rock the clamp about the fulcrum 30. As the fulcrum is defined by a segmentally cylindrical surface 31 engaging the canted surface 19, force applied by the tightening of the bolt is directed accurately to the force-applying portion 33 of the clamp by a third class lever arrangement. The clamp segmentally cylindrical surfaces 29, 31, and 34 are preselected to be accurately axially parallel to each other so that a force transmitted as a result of the rocking action of the clamp from force-applying surface 34 to the holding surface 35 of the nozzle body is caused to be accurately parallel to the longitudinal extent of the longitudinal axis 20' of the nozzle, thereby providing an improved sealed association of the nozzle body 13 with the engine head and, more specifically, with the boss surface 19, as seen in FIG. 2. As further shown in FIG. 2, a sealing gasket 40 may be provided therebetween.

Thus, the clamp means 10 of the present invention is arranged to be secured to the engine head so as to forcibly engage the nozzle body 13 for concurrently positioning the nozzle in a preselected disposition about its axis and applying a clamping force to the nozzle accurately in the direction of the axis. This improved functioning is obtained by arranging the clamping means so as to define a lever wherein the force transfer surfaces have limited contact, such as a line contact therebetween, permitting accurate transfer of the clamping force from the force-applying means, such as bolt 24, to the nozzle.

The invention further comprehends, as discussed above, the utilization of an improved bifurcated clamp which not only provides such improved clamping force, but also accurately positions the nozzle angularly about its longitudinal axis as a concurrent function of the clamping action. The improvement further comprehends the utilization of a clamp functioning in the manner of a lever which may be suitably rocked by the force-applying means to provide the desirable accurate force transfer to the nozzle and, thus, assure the desirable sealed association of the nozzle in accurate alignment with the cylinder head mounting surface.

A highly desirable feature provided by the improved clamp structure is the permissibility of relatively wide tolerances in the spacing of the holding surface 35 from the boss surface 19. Such variations in the spacing may occur because of variations in the thickness of the gasket 40 and as a function of the tolerance limits on the location of the recesses 36 and 36' relative to the lower end of the nozzle body 13. Thus, the cylindrical pressure-applying surface 34 provides a desirable application of holding force accurately parallel to the nozzle axis 20' over a wide range of spacings of holding surface 35 from the boss surface 19 so as to provide improved simplified and economical manufacture of the apparatus. More specifically, the lever operation of the clamp assures that the line contact between the cylindrical clamp surface 34 and the planar holding surface 35 is provided over such wide range of disposition of the holding surface.

INDUSTRIAL APPLICABILITY

The improved fuel injector nozzle retaining means may be utilized in connection with a wide range of industrial applications wherein such nozzles are mounted removably to an engine cylinder head or the like. Illustratively, the fuel injector nozzle retaining means is advantageously adapted for use in engines for use in tractors, earthworking vehicles, and the like.

Other aspects, objects and advantages of this invention can be obtained from a study of the drawings, the disclosure and the appended claims. The foregoing disclosure of specific embodiments is illustrative of the broad inventive concepts comprehended by the invention.

We claim:

1. In an engine structure (12) having a head (16) defining a piston cylinder (17), a planar outer surface (19), a nozzle opening (15) extending through said outer surface and opening into said cylinder, and a fuel injector nozzle (11) having an outer body portion (13) disposed outwardly of said head outer surface and defining a longitudinal extent, said nozzle further having an elongated inner end portion (14) extending longitudinally inwardly from said body portion through said nozzle opening to said cylinder, improved means (10) for retaining the fuel nozzle in said disposition comprising:

a clamp (20) having a segmentally cylindrical fulcrum surface (31) in line contact with said outer surface (19), a force-receiving surface (29), and a force-applying portion (33) defining a segmentally cylindrical force-applying surface (34), said clamp portions being arranged such that a clamping force applied to said force-receiving surface tends to urge said force-applying portion about said fulcrum portion; and means (24) for applying a clamping force to said clamp force-receiving portion, said nozzle body portion defining a planar holding surface (35) engaged by said clamp force-applying portion (33) with a line contact parallel to said fulcrum line contact between said fulcrum surface and head outer surface for urging said nozzle inwardly accurately in the direction of longitudinal extent (20') of said nozzle and into sealed association with said head.

2. The engine structure of claim 1 wherein said clamp force-receiving portion (29) defines a rounded surface.

3. The engine structure of claim 1 wherein said means for applying the clamping force defines a force transfer surface (28) configured to have line contact with said clamp force-receiving portion (29) parallel to said line contact between said fulcrum portion and said outer surface portion.

4. The engine structure of claim 1 wherein said force-applying portion (33) and said holding surface (35) are cooperatively configured to have line contact therebetween.

5. In an engine structure (12) having a head (16) defining a piston cylinder (17), a planar outer surface (19), a bore (15) extending through said outer surface and opening into said cylinder, and a fuel injector nozzle (11) having an outer body portion (13) disposed outwardly of said head outer surface and defining a longitudinal extent, said nozzle further having an elongated inner end portion (14) extending longitudinally inwardly from said body portion through said nozzle opening to said cylinder, improved means (10) for retaining the fuel injector nozzle in such disposition comprising:

a clamp (20) having a segmentally cylindrical fulcrum surface (31) in line contact with said head outer surface (19), a force-applying portion (33), and a segmentally cylindrical force-receiving surface (29) disposed intermediate said fulcrum and force-applying portions to define therewith a third class lever (27) whereby a clamping force applied to said force-receiving surface urges said force-applying portion about said fulcrum surface; and means (24) defining a planar surface having a line contact with said force-receiving surface (29) for applying a clamping force to said force-receiving surface, said nozzle body portion defining a holding surface (35) in contact with said clamp force-applying portion, said line contacts being parallel to each other for urging said nozzle inwardly accurately in the direction of longitudinal extent (20') of said nozzle and into sealed association with said head as a result of the application of said clamping force to said force-receiving portion.

6. The engine structure of claim 5 wherein said nozzle body (13) and clamp (20) further define cooperating abutting surfaces (37,38) for positioning the nozzle in a preselected disposition about the longitudinal extent thereof.

7. The engine structure of claim 5 wherein said force-receiving surface (29) is segmentally cylindrical and said means for applying the clamping force comprises threadedly adjustable means (24) carried by said head and defines a planar surface in line contact with said force-receiving surface (29).

8. The engine structure of claim 5 wherein said means for applying the clamping force comprises means (28) adjustably carried by said head and defining a line contact with said force-receiving surface (29).

9. The engine structure of claim 5 wherein said nozzle body (13) is provided with a pair of recesses (36) each defining a said holding surface (35) and said clamp comprises a bifurcated element (20) having a pair of legs (22,23) each defining a said force-applying portion (33) engaging one each said pair of recess holding surfaces (35).

10. The engine structure of claim 9 wherein said force-applying portions engage said holding surfaces (35) with a colinear line contact.

11. The engine structure of claim 9 wherein said force-applying portion defines coaxial cylindrical segments (33).

12. The engine structure of claim 9 wherein said force-applying portion defines coaxial cylindrical segments (33) and said fulcrum surface (31) defines a single cylindrical surface.

13. The engine structure of claim 9 wherein said force-applying portion defines coaxial cylindrical segments (33) and said force-receiving portion defines a cylindrical segment axially parallel to the axis of said force-applying portion cylindrical segments (33).

14. The engine structure of claim 9 wherein said force-applying portion (33) defines coaxially cylindrical segments (34) and said force-receiving portion defines coaxial cylindrical segments (29) axially parallel to the axis of said force-applying portion cylindrical segments (34).

15. In an engine structure (12) having a head (16) defining a piston cylinder (17), a planar outer surface (19), a nozzle opening (15) extending through said outer surface and opening into said cylinder, and a fuel injector nozzle (11) having an outer body portion (13) disposed outwardly of said head outer surface portion and defining a longitudinal extent, said nozzle further having an elongated inner end portion (14) extending longitudinally inwardly from said body portion through said nozzle opening to said cylinder, improved means (10)

for retaining the fuel nozzle in said disposition comprising:

a clamp (20) having a segmentally cylindrical fulcrum surface (31) engaging said outer surface portion (19), a segmentally cylindrical force-receiving surface (29), and a segmentally cylindrical force-applying surface (34), said clamp portions being arranged such that a clamping force applied to said force-receiving portion tends to urge said force-applying portion about said fulcrum portion; and adjustable means (24) defining a planar surface for applying a clamping force to said force-receiving surface (29), said nozzle body portion defining a planar holding surface (35) engaged by said force-applying surface (34) for urging said nozzle inwardly accurately in the direction of longitudinal extent (20') of said nozzle and into sealed association with said head, said fulcrum surface (31) defining with said head outer surface portion (18) a first line contact, said force-receiving portion (29) defining with said adjustable means planar surface a second line contact, and said force-applying surface (34) defining with said nozzle body holding surface (35) a third line contact, all of said line contacts being parallel to each other.

16. The engine structure of claim 15 wherein said planar nozzle body holding surface is accurately perpendicular to said longitudinal extent of the nozzle body.

* * * * *